US009500372B2

(12) United States Patent
Ginesin et al.

(10) Patent No.: US 9,500,372 B2
(45) Date of Patent: Nov. 22, 2016

(54) MULTI-ZONE COMBUSTOR

(75) Inventors: Leonid Yulevich Ginesin, Moscow (RU); Borys Borysovich Shershnyov, Moscow (RU); Andrey Pavlovich Subbota, Moscow (RU); Almaz Kamilevich Valeev, Kazan (RU)

(73) Assignee: General Electric Company, Schenectady, NY (US)

( * ) Notice: Subject to any disclaimer, the term of this patent is extended or adjusted under 35 U.S.C. 154(b) by 128 days.

(21) Appl. No.: 13/983,936

(22) PCT Filed: Dec. 5, 2011

(86) PCT No.: PCT/RU2011/000970

§ 371 (c)(1),
(2), (4) Date: Aug. 6, 2013

(87) PCT Pub. No.: WO2013/085411

PCT Pub. Date: Jun. 13, 2013

(65) Prior Publication Data

US 2014/0260259 A1 Sep. 18, 2014

(51) Int. Cl.

| | |
|---|---|
| ***F23R 3/34*** | (2006.01) |
| ***F23R 3/28*** | (2006.01) |
| ***F23R 3/14*** | (2006.01) |
| ***F23R 3/54*** | (2006.01) |

(52) U.S. Cl.

CPC ..... *F23R 3/34* (2013.01); *F23R 3/286* (2013.01); *F23R 3/346* (2013.01); *F23R 3/54* (2013.01)

(58) Field of Classification Search

CPC ..... F23R 3/286; F23R 3/14; F23R 3/283; F23R 3/32; F23R 3/34–3/346; F23D 14/62; F23D 14/64; F23D 14/10; F23D 14/105; F23D 2203/007

See application file for complete search history.

(56) References Cited

U.S. PATENT DOCUMENTS 3,713,588 A * 1/1973 Sharpe ..... F23R 3/14 239/400
3,917,173 A * 11/1975 Singh ..... B05B 7/0075 239/400

(Continued)

FOREIGN PATENT DOCUMENTS

CN 1450304 A 10/2003
CN 1957208 A 5/2007

(Continued)

OTHER PUBLICATIONS

Translation of a CN Office Action issued on Feb. 16, 2015 in relation to corresponding CN application 201180075320.8.

(Continued)

*Primary Examiner* — Phutthiwat Wongwian
*Assistant Examiner* — Rene Ford
(74) *Attorney, Agent, or Firm* — Ernest G. Cusick; Hoffman Warnick LLC

(57) ABSTRACT

A multi-zone combustor is provided and includes a pre-mixer configured to output a first mixture to a primary zone of a combustor section and a stepped center body disposable in an annulus defined within the pre-mixer. The stepped center body includes an outer body configured to output at a first radial and axial step a second mixture to a secondary zone of the combustor section and an inner body disposable in an annulus defined within the outer body and configured to output at a second radial and axial step a third mixture to a tertiary zone of the combustor section.

20 Claims, 1 Drawing Sheet

(56) References Cited

U.S. PATENT DOCUMENTS

| | | | | |
|---|---|---|---|---|
| 4,162,140 | A * | 7/1979 | Reed | F23D 17/00 239/405 |
| 4,230,445 | A * | 10/1980 | Janssen | F23C 7/004 431/116 |
| 4,589,260 | A * | 5/1986 | Krockow | F23D 11/005 60/737 |
| 5,998,252 | A | 12/1999 | Huang | |
| 6,124,192 | A | 9/2000 | Jeng et al. | |
| 6,655,147 | B2 | 12/2003 | Farmer et al. | |
| 6,698,207 | B1 | 3/2004 | Wiebe | |
| 6,983,600 | B1 * | 1/2006 | Dinu | F23R 3/40 60/39.822 |
| 7,003,958 | B2 * | 2/2006 | Dinu | F23R 3/286 60/39.822 |
| 7,007,478 | B2 * | 3/2006 | Dinu | F23R 3/286 60/39.822 |
| 7,024,861 | B2 | 4/2006 | Martling | |
| 7,631,499 | B2 | 12/2009 | Bland | |
| 7,886,539 | B2 | 2/2011 | Cai | |
| 2004/0006988 | A1 | 1/2004 | Stuttaford | |
| 2004/0006990 | A1 | 1/2004 | Stuttaford | |
| 2007/0231762 | A1 | 10/2007 | Bernero et al. | |
| 2009/0272116 | A1 * | 11/2009 | Bland | F23C 6/047 60/737 |
| 2009/0277182 | A1 | 11/2009 | Engelbrecht | |
| 2010/0058732 | A1 * | 3/2010 | Kaufmann | F23C 9/006 60/39.52 |
| 2010/0146983 | A1 * | 6/2010 | Hellat | F23R 3/343 60/772 |
| 2012/0234011 | A1 * | 9/2012 | Popovic | F23R 3/10 60/740 |

FOREIGN PATENT DOCUMENTS

| | | | |
|---|---|---|---|
| JP | H05203150 | A | 8/1993 |
| JP | H05340508 | A | 12/1993 |
| JP | H0755148 | A | 3/1995 |
| JP | 2011137390 | A | 7/2011 |
| RU | 2227247 | | 4/2004 |

OTHER PUBLICATIONS

International Search Report mailed Sep. 27, 2012 in PCT/RU2011/000970, pp. 1-3.

Russian application No. 2014120381 official action dated May 5, 2016 Our ref: GEEN-0791 11 pages.

* cited by examiner

MULTI-ZONE COMBUSTOR

CROSS-REFERENCE TO RELATED APPLICATION

This National Stage application claims the benefit of priority to PCT International Application No. PCT/RU2011/00970, which was filed on Dec. 5, 2011. The entire contents of PCT International Application No. PCT/RU2011/00970 are incorporated herein by reference.

BACKGROUND OF THE INVENTION

The subject matter disclosed herein relates to a multi-zone combustor and, more particularly, to a multi-zone combustor having a stepped center body.

In gas turbine engines, a compressor compresses inlet gases to produce compressed gas. This compressed gas is transmitted to a combustor where the compressed gas may be mixed with fuel and combusted to produce a fluid flow of high temperature fluids. These high temperature fluids are transmitted to a turbine section in which energy of the high temperature fluids is converted into mechanical energy for use in the production of power and/or electricity.

During full speed, full load operational conditions, this arrangement may be highly efficient and tends to produce relatively little pollutant emissions. However, during turndown or part load conditions, the fuel and air mixing and subsequent combustion do not occur at temperatures and mass flow rates that lead to efficient combustion. The process may therefore produce an increase in pollutant emissions as well as unnecessarily reduced power and/or electricity production.

BRIEF DESCRIPTION OF THE INVENTION

According to one aspect of the invention, a multi-zone combustor is provided and includes a pre-mixer configured to output a first mixture to a primary zone of a combustor section and a stepped center body disposable in an annulus defined within the pre-mixer. The stepped center body includes an outer body configured to output at a first radial and axial step a second mixture to a secondary zone of the combustor section and an inner body disposable in an annulus defined within the outer body and configured to output at a second radial and axial step a third mixture to a tertiary zone of the combustor section.

According to another aspect of the invention, a multi-zone combustor is provided and includes a combustor body having a head end, a combustor section downstream from the head end and a mixing section interposed between the head end and the combustor section, a pre-mixer extendible from the head end through the mixing section and configured to output at a first axial location a first mixture to the combustor section and a stepped center body disposable in an annulus defined within the pre-mixer. The stepped center body includes an outer body configured to output at a second axial location downstream from the first axial location a second mixture to the combustor section and an inner body disposable in an annulus defined within the outer body and configured to output at a third axial location downstream from the second axial location a third mixture to the combustor section.

According to yet another aspect of the invention, a multi-zone combustor is provided and includes a combustor body having a head end, a combustor section downstream from the head end and a mixing section interposed between the head end and the combustor section, a pre-mixer extendible from the head end through the mixing section and configured to output at a first axial location a first mixture to the combustor section and a stepped center body disposable in an annulus defined within the pre-mixer. The stepped center body includes an outer body configured to output at a second axial location downstream from the first axial location a second mixture to the combustor section and an inner body disposable in an annulus defined within the outer body and configured to output at a third axial location downstream from the second axial location a third mixture to the combustor section.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
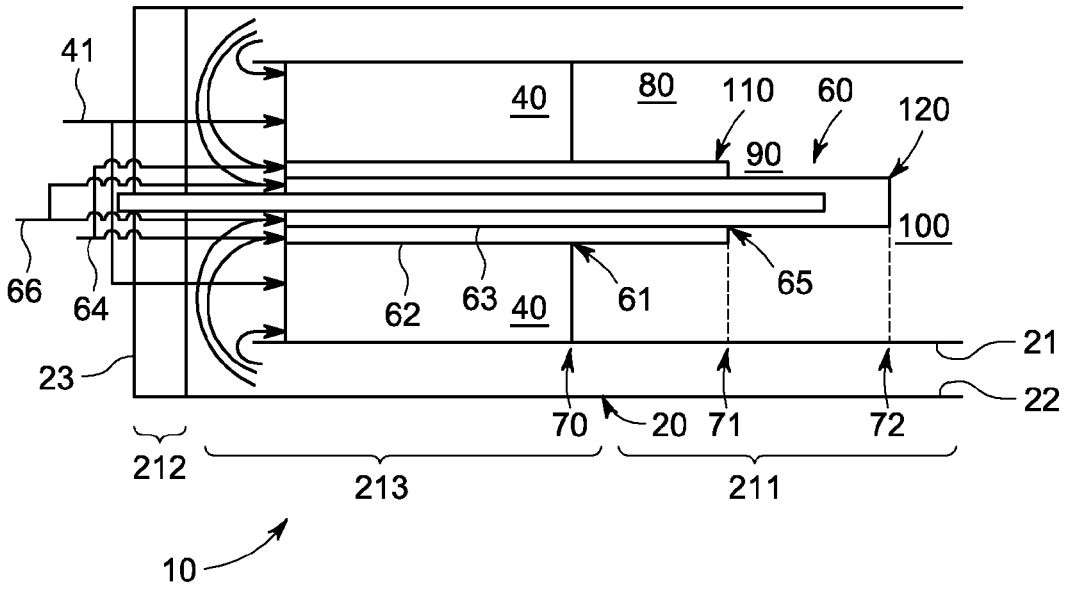
FIG. 1 is a side view of a multi-zone combustor.

With reference to FIG. 1, a multi-zone combustor 10 of a turbomachine, such as a gas turbine engine, is provided. In the exemplary gas turbine engine, a compressor compresses inlet gases to produce compressed gas. This compressed gas is transmitted to the multi-zone combustor 10 where the compressed gas may be mixed with fuel and combusted to produce a fluid flow of high temperature fluids. These high temperature fluids are transmitted to a turbine section in which energy of the high temperature fluids is converted into mechanical energy for use in the production of power and/or electricity.

The multi-zone combustor 10 includes a combustor body 20, a pre-mixer 40 and a stepped center body 60. The combustor body 20 includes a combustor liner 21, which is annular and formed to define a combustor section 211 with a combustion zone therein, a combustor flow sleeve 22, which is provided about the combustor liner 21 to define an annulus through which at least the compressed gas produced by the compressor flows, and an end cover 23, which defines a head end 212 of the multi-zone combustor 10. The combustor section 211 is defined downstream from the head end 212 with a mixing section 213 axially interposed therebetween.

The pre-mixer 40 is extendible from the head end 212 through the mixing section 213 and may be annular in shape or provided as a series of cavities in an annular array. In any case, the pre-mixer 40 is receptive of a first quantity of fuel from a first fuel circuit 41 and a first quantity of the compressed gas produced by the compressor. The first quantity of the fuel and the first quantity of the compressed gas are mixed along an axial length of the pre-mixer 40 and output as a first mixture at a first axial location 70 to a primary zone 80 of the combustor section 211. The primary zone 80 is defined to extend aft from a forward portion of the combustor section 211 and may be radially proximate to the combustor liner 21.

Figure 2:
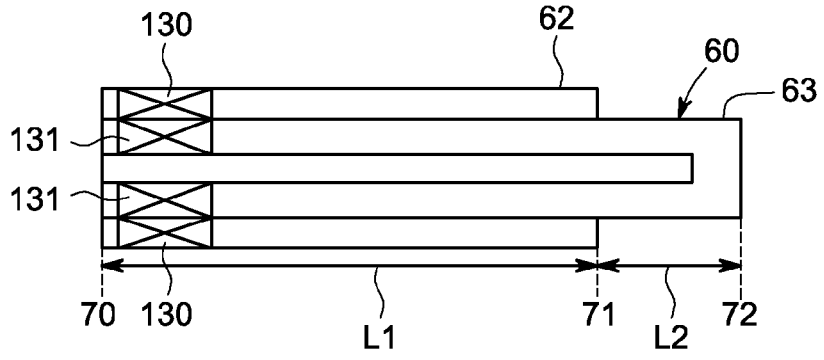
FIG. 2 is an enlarged side view of a center body of the multi-zone combustor of FIG. 1.

With reference to FIGS. 1 and 2, the stepped center body 60 is disposable in an annulus 61 defined within the pre-mixer 40 and includes at least an outer body 62 and an inner body 63. The outer body 62 is receptive of a second quantity of fuel from a second fuel circuit 64 and a second quantity of the compressed gas produced by the compressor. The second quantity of the fuel and the second quantity of the compressed gas are mixed along an axial length of the outer body 62 and output as a second mixture at a second axial location 71, which is downstream from the first axial location 70, to a secondary zone 90 of the combustor section 211. The secondary zone 90 is defined radially inwardly from the primary zone 80 and is defined to extend aft from the second axial location 71. The second axial location 71 is provided at an axial distance, L1, from the first axial location 70. The outer body 62 is thus configured to output the second mixture to the secondary zone 90 at a first radial and axial step 110.

The inner body 63 is disposable in an annulus 65 defined within the outer body 62. The inner body 63 is receptive of a third quantity of fuel from a third fuel circuit 66 and a third quantity of the compressed gas produced by the compressor. The third quantity of the fuel and the third quantity of the compressed gas are mixed along an axial length of the inner body 63 and output as a third mixture at a third axial location 72, which is downstream from the second axial location 71, to a tertiary zone 100 of the combustor section 211. The tertiary zone 100 is defined radially inwardly from the secondary zone 90 and is defined to extend aft from the third axial location 72. The third axial location 72 is provided at an axial distance, L2, from the second axial location 71. The inner body 63 is thus configured to output the third mixture to the tertiary zone 100 at a second radial and axial step 120.

In accordance with embodiments, the axial distances, L1 and L2, may be similar to one another or different from one another depending on design considerations and operability requirements.

The first fuel circuit 41, the second fuel circuit 64 and the third fuel circuit 66 are independent from one another and separately controlled such that the first mixture, the second mixture and the third mixture are fueled independently and separately. In this way, relative quantities of the fuel and the compressed gases in each can be controlled independently and separately in accordance with an operational mode of the multi-zone combustor 10. For example, during full speed, full load (FSFL) operation, the first mixture, the second mixture and the third mixture may all contain fuel and compressed gases. By contrast, during turndown or part load operation, the second mixture and the third mixture may contain compressed gases and substantially reduced amounts (i.e., none or trace amounts) of fuel.

As shown in FIG. 2, the outer body 62 may include a first row of vanes 130 and the inner body 63 may include a second row of vanes 131. In accordance with embodiments, the first row of vanes 130 and the second row vanes may be configured to impart a swirl to the second mixture and the third mixture, respectively. This swirl can be provided such that the second mixture and the third mixture are each output in a co-rotational condition or in a counter-rotational condition. In either case, the swirl may be provided with equal/similar swirl angles or different swirl angles. Although the first row of the vanes 130 and the second row of the vanes 131 are illustrated as being disposed aft of the first axial location 70, it is to be understood that this is merely exemplary and that the first row of the vanes 130 and the second row of the vanes 131 can be disposed forward, aft and/or coaxial with the first axial location 70.

Figure 3:
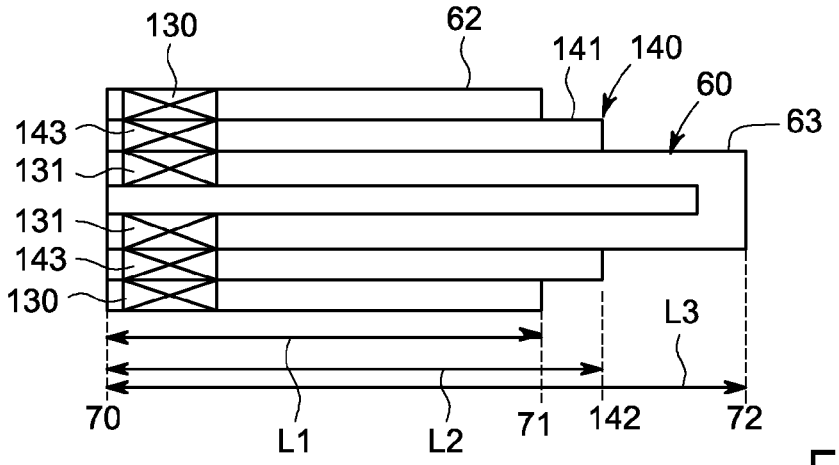
FIG. 3 is an enlarged side view of the center body of FIG. 2 in accordance with further embodiments.

With reference to FIG. 3 and, in accordance with further embodiments, at least one or more additional radial and axial step(s) 140 may be provided for the stepped center body 60. For clarity and brevity, only one additional radial and axial step 140 will be described, although it is to be understood that this is merely exemplary. Where the stepped center body 60 includes the additional radial and axial step 140, the stepped center body 60 further includes an additional body 141, which is disposable between the outer body 62 and the inner body 63. The additional body 141 is independently and separately supplied with fuel and compressed gases, which are mixed along an axial length of the additional body 141 and output as a fourth mixture at a fourth axial location 142, which is downstream from the second axial location 71 and upstream from the third axial location 72, to the combustor section 211. The second axial location 71 is provided at an axial distance, L1, from the first axial location 70, the fourth axial location 142 is provided at an axial distance, L2, from the first axial location 70 and the third axial location 72 is provided at an axial distance, L3, from the first axial location 70. The additional body 141 is thus configured to output the fourth mixture at the additional radial and axial step 140.

The additional body 141 may also include an additional row of vanes 143 to impart swirl to the fourth mixture in a similar or different direction/angle as the first row of vanes 130 and/or the second row of vanes 131. As above, although the first row of the vanes 130, the second row of the vanes 131 and the additional row of the vanes 143 are illustrated as being disposed aft of the first axial location 70, it is to be understood that this is merely exemplary and that the first row of the vanes 130, the second row of the vanes 131 and the additional row of the vanes 143 can be disposed forward, aft and/or coaxial with the first axial location 70.

In accordance with embodiments, the axial distances, L1, L2 and L3, may be arranged with similar or different axial spacing from one another depending on design considerations and operability requirements.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A multi-zone combustor, comprising:

a pre-mixer configured to output a first mixture to a primary zone of a combustor section; and a stepped center body disposed in a first annulus defined within the pre-mixer and including:

an outer tube configured to output at a first radial and axial step a second mixture to a secondary zone of the combustor section downstream of the primary zone, and an inner tube positioned within the outer tube, thereby defining a second annulus between the outer tube and the inner tube, the inner tube being configured to output at a second radial and axial step a third mixture to a tertiary zone of the combustor section downstream of the secondary zone, wherein the inner tube, the outer tube, and the pre-mixer are concentrically arranged around a common longitudinal axis.

2. The multi-zone combustor according to claim 1, wherein the first mixture, the second mixture and the third mixture are provided to the pre-mixer, to the outer tube, and to the inner tube, respectively, by a first fuel circuit, a second fuel circuit, and a third fuel circuit.

3. The multi-zone combustor according to claim 1, wherein a first plurality of vanes are positioned within the second annulus and a second plurality of vanes are positioned within the inner tube, the first plurality of vanes and the second plurality of vanes being configured such that the second mixture and the third mixture are each output in a co-rotation condition.

4. The multi-zone combustor according to claim 1, wherein a first plurality of vanes are positioned within the second annulus and a second plurality of vanes are positioned within the inner tube, the first plurality of vanes and the second plurality of vanes being configured such that the second mixture and the third mixture are each output in a counter-rotation condition.

5. The multi-zone combustor according to claim 1, wherein a first plurality of vanes are positioned within the second annulus and a second plurality of vanes are positioned within the inner tube, the first plurality of vanes and the second plurality of vanes being configured such that the second mixture and the third mixture are each output with equal rotation angles.

6. The multi-zone combustor according to claim 1, wherein the stepped center body further includes an additional body disposed between the outer tube and the inner tube and configured to output at a third radial and axial step a fourth mixture to a fourth zone of the combustor section, the fourth zone being located axially between the secondary zone and the tertiary zone.

7. A multi-zone combustor, comprising:

a combustor body having a head end, a combustor section downstream from the head end and a mixing section interposed between the head end and the combustor section;

a pre-mixer extendible from the head end through the mixing section and configured to output at a first axial location a first mixture to the combustor section; and a stepped center body disposed in a first annulus defined within the pre-mixer and including:

an outer tube configured to output at a second axial location downstream from the first axial location a second mixture to the combustor section, and an inner tube positioned within the outer tube, thereby defining a second annulus between the outer tube and the inner tube, the inner tube being configured to output at a third axial location downstream from the second axial location a third mixture to the combustor section, wherein the inner tube, the outer tube, and the pre-mixer share a common longitudinal axis.

8. The multi-zone combustor according to claim 7, wherein the first mixture, the second mixture and the third mixture are provided to the pre-mixer, to the outer tube, and to the inner tube, respectively, by a first fuel circuit, a second fuel circuit, and a third fuel circuit.

9. The multi-zone combustor according to claim 7, wherein the second mixture and the third mixture include air and no amount or trace amounts of fuel during turndown operations.

10. The multi-zone combustor according to claim 7, wherein a first plurality of vanes are positioned within the second annulus and a second plurality of vanes are positioned within the inner tube, the first plurality of vanes and the second plurality of vanes being configured such that the second mixture and the third mixture are each output in a co-rotation condition.

11. The multi-zone combustor according to claim 7, wherein a first plurality of vanes are positioned within the second annulus and a second plurality of vanes are positioned within the inner tube, the first plurality of vanes and the second plurality of vanes being configured such that the second mixture and the third mixture are each output in a counter-rotation condition.

12. The multi-zone combustor according to claim 7, wherein a first plurality of vanes are positioned within the second annulus and a second plurality of vanes are positioned within the inner tube, the first plurality of vanes and the second plurality of vanes being configured such that the second mixture and the third mixture are each output with equal rotation angles.

13. The multi-zone combustor according to claim 7, wherein the stepped center body further includes an additional body disposed between the outer tube and the inner tube and configured to output at a fourth axial location downstream from the second axial location a fourth mixture to the combustor section.

14. A multi-zone combustor, comprising:

a combustor body having a head end, a combustor section downstream from the head end and a mixing section interposed between the head end and the combustor section;

a pre-mixer extendible from the head end through the mixing section and configured to output at a first axial location a first mixture to the combustor section, the pre-mixer defining a first annulus along a longitudinal axis of the combustor body; and a stepped center body disposed in the first annulus and including:

an outer tube having a first length and configured to output at a second axial location downstream from the first axial location a second mixture to the combustor section, and an inner tube positioned within the outer tube, thereby defining a second annulus between the outer tube and the inner tube, the inner tube having a second length longer than the first length and being configured to output at a third axial location downstream from the second axial location a third mixture to the combustor section.

15. The multi-zone combustor according to claim 14, wherein the first mixture, the second mixture and the third mixture are provided to the pre-mixer, to the outer tube, and to the inner tube, respectively, by a first fuel circuit, a second fuel circuit, and a third fuel circuit.

16. The multi-zone combustor according to claim 14, wherein the second mixture and the third mixture include air and no amount or trace amounts of fuel during turndown operations.

17. The multi-zone combustor according to claim 14, wherein a first plurality of vanes are positioned within the second annulus and a second plurality of vanes are positioned within the inner tube, the first plurality of vanes and the second plurality of vanes being configured such that the second mixture and the third mixture are each output in a co-rotation condition.

18. The multi-zone combustor according to claim 14, wherein a first plurality of vanes are positioned within the second annulus and a second plurality of vanes are positioned within the inner tube, the first plurality of vanes and the second plurality of vanes being configured such that the second mixture and the third mixture are each output in a counter-rotation condition.

19. The multi-zone combustor according to claim 14, wherein a first plurality of vanes are positioned within the second annulus and a second plurality of vanes are positioned within the inner tube, the first plurality of vanes and the second plurality of vanes being configured such that the second mixture and the third mixture are each output with equal rotation angles.

20. The multi-zone combustor according to claim 14, wherein the stepped center body further includes an additional body disposed between the outer tube and the inner tube and configured to output at a fourth axial location downstream from the second axial location a fourth mixture to the combustor section.

* * * * *